US008079379B2

(12) United States Patent
Peron

(10) Patent No.: US 8,079,379 B2
(45) Date of Patent: Dec. 20, 2011

(54) BABY WALKING APPARATUS HAVING A DOUBLE WINDING SHAPE AND TWO PAIRS OF HANDLEBARS PARALLED TO A WHEEL AXLE

(76) Inventor: Antonio Vilar Peron, Oleiros Coruña (ES)

( * ) Notice: Subject to any disclaimer, the term of this patent is extended or adjusted under 35 U.S.C. 154(b) by 5 days.

(21) Appl. No.: 12/594,178

(22) PCT Filed: Mar. 27, 2008

(86) PCT No.: PCT/ES2008/000182

§ 371 (c)(1),
(2), (4) Date: Sep. 30, 2009

(87) PCT Pub. No.: WO2008/135609

PCT Pub. Date: Nov. 13, 2008

(65) Prior Publication Data

US 2010/0101616 A1 Apr. 29, 2010

(30) Foreign Application Priority Data

May 3, 2007 (ES) ..... U 200700906

(51) Int. Cl.
*A45B 1/02* (2006.01)
*A45B 9/02* (2006.01)
*A45B 7/00* (2006.01)

(52) U.S. Cl. ..... 135/85; 135/65; 135/74; 135/76

(58) Field of Classification Search ..... 135/65, 135/66, 67, 74, 76, 85; 434/255; 482/66, 482/68; 280/826, 87.051; 472/15; D12/130
See application file for complete search history.

(56) References Cited

U.S. PATENT DOCUMENTS 1,332,461 A 3/1920 Bowden et al.
1,729,557 A 9/1929 Stoll
(Continued)

FOREIGN PATENT DOCUMENTS

CH 220716 A 4/1942
(Continued)

OTHER PUBLICATIONS

International Search Report, Jul. 4, 2008, from International Phase of the instant application.

(Continued)

*Primary Examiner* — David Dunn
*Assistant Examiner* — Danielle Jackson
(74) *Attorney, Agent, or Firm* — Jackson Patent Law Office

(57) ABSTRACT

The invention relates to a baby walking stick which facilitates and accelerates the transition from crawling to walking in a physiologically appropriate manner. In addition, the invention prevents the accompanying adult from adopting unsuitable postures and the design of the stick provides increased safety by connecting the adult and the baby. The invention comprises a folding stick having an upper curved section which curves around the baby's erect head. The upper end of the stick is provided with a T-shaped handle for the adult and the centre of the stick, at the height of the baby's arms, is provided with handlebars with which the baby can hold himself/herself upright. The lower end of the stick is provided with two wheels so that the stick slides as the baby and adult walk, which wheels are in contact with the ground and joined by an axle parallel to the above-mentioned handle and handlebars, all of said components being disposed in parallel to the direction of movement.

4 Claims, 2 Drawing Sheets

U.S. PATENT DOCUMENTS

| | | | | |
|---|---|---|---|---|
| 2,379,426 | A * | 7/1945 | Edstrom | 135/85 |
| 2,545,009 | A | 3/1951 | Spiteri | |
| 3,158,851 | A * | 11/1964 | Ruthven | 340/517 |
| 3,251,371 | A * | 5/1966 | Croker | 135/66 |
| 3,529,819 | A | 9/1970 | Blank et al. | |
| 5,188,138 | A | 2/1993 | Yamasaki et al. | |
| 5,432,341 | A * | 7/1995 | Gspann | 250/251 |
| 5,875,805 | A * | 3/1999 | Nichols | 135/66 |
| 6,196,949 | B1 | 3/2001 | Rodarte et al. | |
| 6,342,032 | B1 * | 1/2002 | Affield | 482/74 |
| 6,895,982 | B1 * | 5/2005 | Shaw | 135/16 |
| 2003/0205265 | A1 | 11/2003 | Nasco | |

FOREIGN PATENT DOCUMENTS

| | | | |
|---|---|---|---|
| GB | 2 392 392 | A | 3/2004 |

OTHER PUBLICATIONS

Communication dated Dec. 23, 2009 from International Phase of the instant application.

* cited by examiner

BABY WALKING APPARATUS HAVING A DOUBLE WINDING SHAPE AND TWO PAIRS OF HANDLEBARS PARALLED TO A WHEEL AXLE

SUBJECT OF THE INVENTION

The invention, as set forth in the present specification, refers to a baby walking stick.

More particularly, the subject of the invention consists in a stick whose purpose is to provide an element of support and assistance for the first steps of a baby between approximately seven and fourteen months old, guided by an adult, in his or her transition from crawling to upright walking, which stick is safe and anatomically appropriate and convenient both for the baby and for the adult supporting him or her.

PRIOR ART

As is known, at a certain age babies necessarily pass through a learning stage until they are able to walk upright with sufficient security to do so all by themselves, during which time, even though various types of [training] elements are known, such as walkers or the like, it is generally an adult who accompanies the baby, since this type of [training] element, besides not being very safe, only provides independence and not a true training of the baby.

Therefore, such accompanying is usually done by supporting the child, either by the hands with the baby's arms raised, which can even turn out to be dangerous to the delicate bones and tendons of the child, or by grasping him or her beneath the armpits, with the adult in both cases in a posture uncomfortable to his/her back, which is therefore hard to maintain for a lengthy time, or is sometimes even impossible for some people.

It should be pointed out, on the other hand, that at the present time, and with regard to the prior art, the applicant is unaware of the existence of any baby walking stick having technical, structural and configuration characteristics similar to those of the one specified here.

EXPLANATION OF THE INVENTION

Thus, the baby walking stick of the present invention in itself constitutes an obvious innovation within its field of application, since one achieves with it a training of the baby in the strict sense through the direct relation with the adult necessarily accompanying the baby, while also preventing the adult from becoming tired or assuming unnatural postures from the mere fact of accompanying the baby's first steps.

Thus, the walks will last until the child becomes tired, and not the adult. Furthermore, the child will advantageously assume an ergonomic posture proper to walking, and will learn to walk on all types of ground, to go up and down stairs and ramps, and even if he or she loses his or her footing, thanks to learning quickly to hold onto the handlebars, the child will learn to regain his/her footing without danger of hurting himself/herself.

Even though generally the baby will quickly master the stick, it is recommended to make additional use of a harness to increase the safety of the baby during the first sessions or uses of the stick.

Specifically, the invention is a combination of a stick with two sets of handlebars, a lower one for the child to grasp, and another one at greater height for guidance by the adult, and two wheels. Thus, both the adult and the baby are joined by a fixed rod, the principal axis, at whose end closest to the ground there are two wheels, one on each side, preferably made of thick-walled PVC and around 70 mm in diameter, joined by a nylon axle that will give the wheels the suspension and capacity to adapt to the roughness of the terrain, so that the stick can slide over different types of ground when walking, giving the child support in ergonomic fashion.

The fact that there are two handlebars at different height, one for the baby around 65 cm from the ground and one for the adult at approximately 110 cm, lets the adult guide the walking of the baby to a greater or lesser extent, depending on the level of experience of the baby.

Besides being more comfortable to both child and adult, the time devoted to this walking training will be increased, achieving greater ease in less time, and therefore shortening the transition period.

The new baby walking stick thus constitutes an innovative structure of structural and constituent characteristics thus far not known for this purpose, which along with its practical utility provides it sufficient foundation for obtaining the exclusive protection that is requested.

DESCRIPTION OF THE DRAWINGS

To supplement the description and in order to assist in a better understanding of the characteristics of the invention, the present specification is accompanied by a set of drawings, being an integral part thereof, showing the following as an illustration and not limited thereto.

PREFERRED EMBODIMENT OF THE INVENTION

Figure 1:
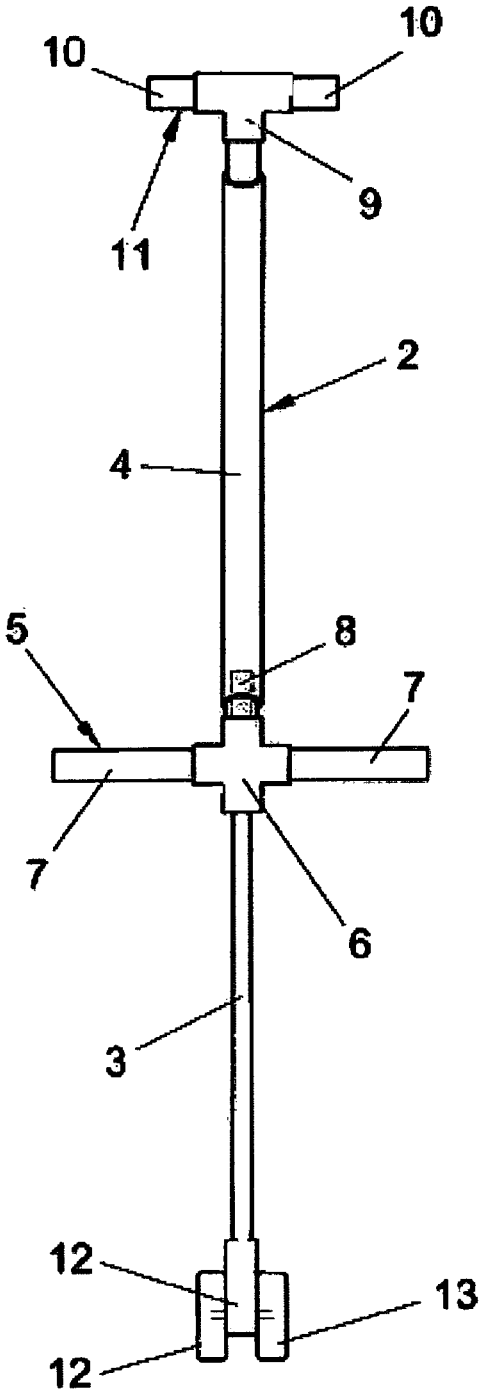
FIG. 1 shows a front elevation view of one nonlimiting embodiment example of the new baby walking stick according to the invention, revealing the main parts and elements of which it is composed, as well as the configuration and arrangement thereof.
Figure 2:
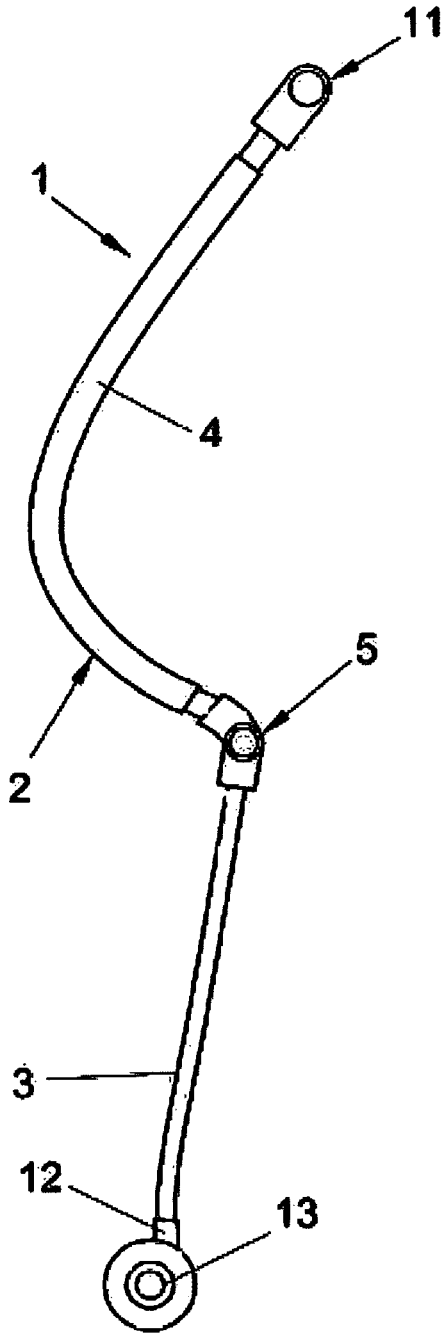
FIG. 2 shows a side elevation view of the example of the stick according to the invention as shown in FIG. 1.
Figure 3:
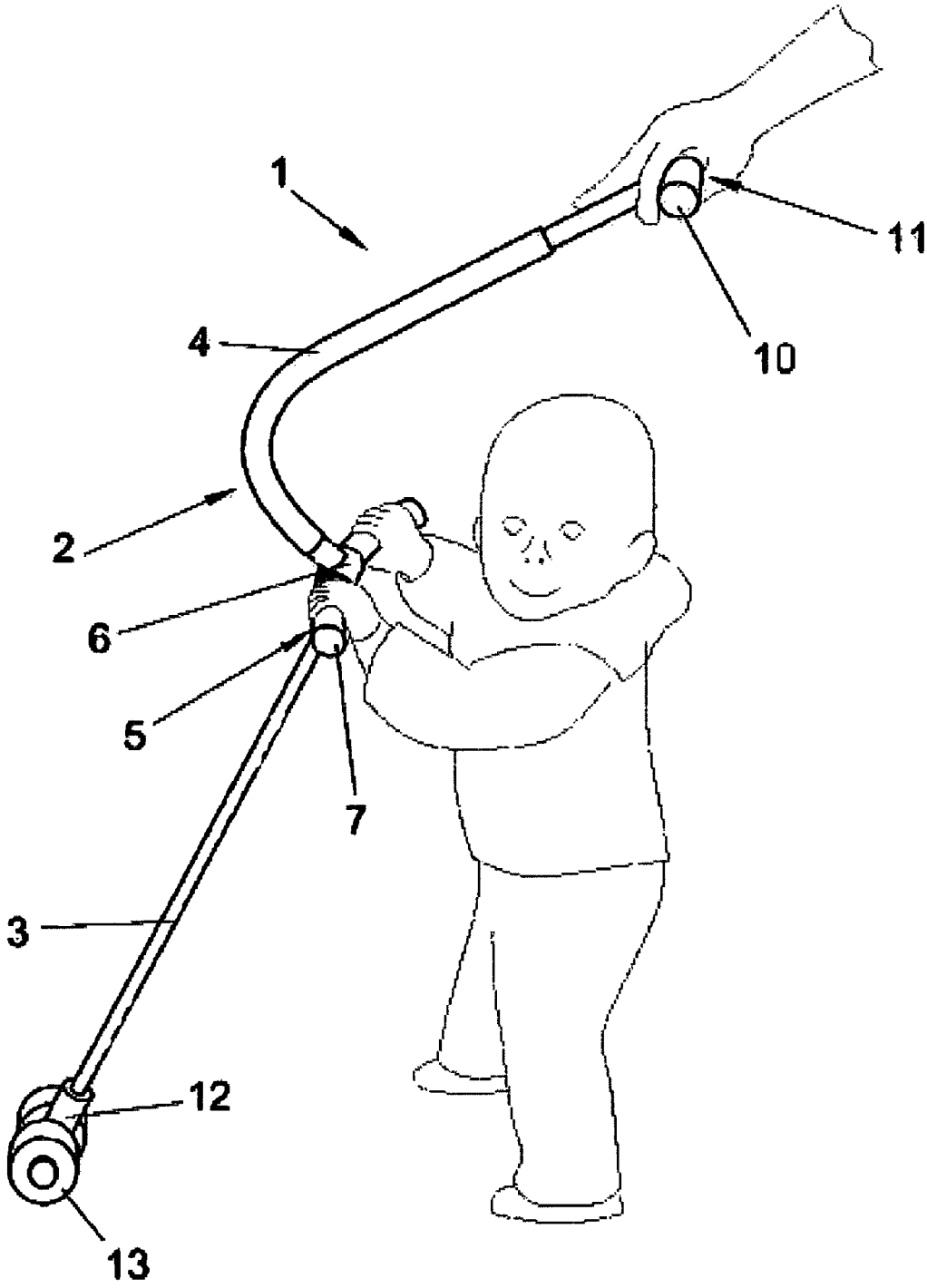
FIG. 3 shows a representation of how the stick of the invention is used, revealing how the baby uses it and how the adult supports and guides the baby.

Looking at the mentioned figures, and in accordance with the numbering scheme, one notices how the walking stick (1) specified by the invention is basically made up of a tubular body or principal axis (2), of adequate length, approximately around 120 cm, formed by the union of a lower tube (3) of straight configuration and an upper tube (4) describing a double winding curve in the dorsoventral direction, the curvature starting at the aforesaid joint of the two tubes, approximately around 65 cm from the lower end of the body (2), the first curve being open toward the front, being 100° (+/−10°), followed by a curve in the opposite direction, that is, backward and more closed, being around 90° (+/−10°). (Another possibility is the first curve being 135° (+/−10°), followed by a curve in the opposite direction, that is, backward and more closed, being around 105° (+/−10°).

This shape in the dorsoventral direction makes it possible to avoid the head of the child during his or her walking, when standing upright and grasping the handlebars (5), which are situated at the start of said curvature, and perpendicular to the principal axis or tube (2).

Said handlebars (5) are formed by a crosspiece (6), made with a molded PVC T-section, in which are fitted, besides handles (7) on either side, the aforesaid lower (3) and upper (4) tubes, advantageously allowing for the disassembly of the walking stick (1) for more convenient storage and transport.

When the stick (1) is assembled, a rubber strip (8), of smaller diameter, fixed inside the upper tube (4) and inserted into said crosspiece (6), keeps the two pieces fitted together. When one wishes to fold the stick, it is enough to pull on one of the pieces which becomes released from one end of the crosspiece (6) and this piece can be pivoted about the stretched rubber (8).

At the upper end of the tube (4), at the end of the stick (1), and after the curve which avoids contact between the stick and the baby's head, there is another T-shaped crosspiece (9), to which are joined at the sides the handles (10) making up the handlebars (11) of the adult, by which one can guide the stick (1) by only one hand or by both hands, from an upright and comfortable posture.

Finally, at the lower end of the straight tube (3), the portion of the tubular body (2) that will be in contact with the ground incorporates a transverse axle (12) of nylon, arranged in parallel with the aforesaid handlebars (5) and (11), which axle passes through said tube (3) and has thermoplastic rubber wheels (13) connected to each end.

The axle (12) and the corresponding nylon nuts and washers allow for an adequate suspension, as well as an independent twisting of the wheels (13), facilitating their adaptation to the roughness of the terrain.

The nature of the present invention having been sufficiently described, as well as how to put it into effect, it is not deemed necessary to provide a more extensive explanation to the person skilled in the art in order to grasp its scope and the benefits deriving from it, or how to proceed with its reproduction, it being noted that, within its essential nature, it can be implemented in other embodiments that differ in detail from the one given as an example, and which likewise shall enjoy the protection being requested, provided that the fundamental principle is not altered, changed or modified.

The invention claimed is:

1. A baby walking apparatus configured to be an element of support and assistance for the first steps of a baby between approximately seven and fourteen months of age, guided by an adult, in his or her transition from crawling to upright walking, the baby walking apparatus comprising:

a first tube of approximately 65 cm in length, the first tube being straight, the first tube defining a first end and a second end;

an axle connected at the first end of the first tube, the axle defining an axis;

a first wheel connected to the axle, the first wheel being configured to contact the ground;

a second wheel connected to the axle, the second wheel being configured to contact the ground;

a first pair of handlebars, arranged parallel to the axis, the first pair of handlebars configured to be grasped by the baby;

a second pair of handlebars, arranged parallel to the axis, the second pair of handlebars configured to be grasped by the adult;

a second tube;

a crosspiece connected between the first tube and the second tube, and a rubber element in the crosspiece and in the second tube; and the second tube defining a first end, connected at the second end of the first tube, and defining a second end, the second tube defining a first curve in a plane normal to the axis of the axle, the first curve being approximately 90°, the first curve starting at the first end of the second tube, the first curve curving in a first direction, the first end of the second tube extending from the crosspiece at approximately 100° relative to the first tube, whereby a head of the baby, when the baby grasps the first pair of handlebars, does not strike the second tube, either when the baby is upright or when the baby stands up from the crawling position.

2. The baby walking apparatus according to claim 1, further characterized in that the first pair of handlebars are formed by the crosspiece, made from a molded PVC T-section, in which are fitted the first and second tubes.

3. The baby walking apparatus according to claim 1, further characterized in that, at the second end of the second tube there is a T-shaped crosspiece, to which is joined the second pair of handlebars.

4. The baby walking apparatus according to claim 1, wherein the axle includes nylon and the wheels include thermoplastic rubber.

* * * * *